United States Patent [19]

Franzen

[11] 4,287,712

[45] Sep. 8, 1981

[54] PNEUMATICALLY DISENGAGEABLE SELF-THREADING YARN BRAKE MECHANISM IN A HOLLOW SPINDLE ASSEMBLY OF A TEXTILE YARN PROCESSING MACHINE AND RELATED METHOD

[75] Inventor: Gustav Franzen, Willich; Johannes Frentzel-Beyme, Monchen-Gladback both of Fed. Rep. of Germany

[73] Assignee: Palitex Project Company GmbH, Krefeld, Fed. Rep. of Germany

[21] Appl. No.: 56,212

[22] Filed: Jul. 10, 1979

[30] Foreign Application Priority Data

Jul. 10, 1978 [DE] Fed. Rep. of Germany ..... 2830265

[51] Int. Cl.[3] ..... D01H 15/00; D01H 7/86

[52] U.S. Cl. ..... 57/279; 57/58.86

[58] Field of Search ..... 57/58.49, 58.7, 58.83–58.86, 57/279, 280

[56] References Cited

U.S. PATENT DOCUMENTS

| | | | |
|---|---|---|---|
| 3,490,221 | 1/1970 | Heimes et al. | 57/58.86 |
| 3,593,511 | 7/1971 | Guignard et al. | 57/280 |
| 3,830,051 | 8/1974 | Veltges | 57/58.83 |
| 3,945,184 | 3/1976 | Franzen | 57/58.86 |
| 3.975.893 | 8/1976 | Franzen | 57/279 |
| 4,168,605 | 9/1979 | D'Agnolo | 57/279 |
| 4,199,929 | 4/1980 | Vessella | 57/279 |

FOREIGN PATENT DOCUMENTS

| | | |
|---|---|---|
| 1510807 | 11/1969 | Fed. Rep. of Germany . |
| 2309578 | 9/1974 | Fed. Rep. of Germany . |
| 2543018 | 3/1977 | Fed. Rep. of Germany . |

*Primary Examiner*—John Petrakes

*Attorney, Agent, or Firm*—Bell, Seltzer, Park & Gibson

[57] ABSTRACT

A textile yarn processing machine, such as a two-for-one twister, is provided with a pneumatically operated yarn threading mechanism for initially threading a yarn through a hollow spindle of the textile processing machine during a thread-up operation and an improved self-threading yarn brake mechanism for applying tension to the yarn as it passes through the hollow spindle during operation of the machine. The improved yarn brake mechanism is constructed to cooperate with the threading mechanism to facilitate automatic threading of the yarn through the hollow spindle and is characterized in that the compressed air which is supplied to the threading mechanism during the thread-up operation also operates to move the yarn brake mechanism from an engaged position to a released position to thus automatically provide a clear path for threading the yarn through the hollow spindle.

14 Claims, 11 Drawing Figures

PNEUMATICALLY DISENGAGEABLE SELF-THREADING YARN BRAKE MECHANISM IN A HOLLOW SPINDLE ASSEMBLY OF A TEXTILE YARN PROCESSING MACHINE AND RELATED METHOD

FIELD OF THE INVENTION

This invention relates to a textile yarn processing machine, such as a two-for-one twister, and more particularly relates to an improved self-threading yarn brake mechanism provided in a hollow spindle assembly of such a machine, and which is constructed to facilitate pneumatically threading the yarn through the spindle assembly. The invention also concerns the related method for pneumatically threading the yarn through the spindle assembly and past the brake mechanism.

BACKGROUND OF THE INVENTION

In textile yarn processing machines, such as two-for-one twisters, yarn is pulled from a hollow supply package carried by a stationary carrier mechanism in each of a plurality of spindle assemblies and passed through the hollow center of the supply package by directing the yarn into the upper end of a yarn inlet tube and through a yarn passageway in the stationary carrier mechanism and through an adjoining yarn passageway in a rotor mechanism and then radially out of the rotor mechanism. Upon leaving the rotor mechanism the yarn is guided upward forming a balloon which rotates around the supply package, and thence to a take-up package. Originally, threading of the yarn through the yarn passageways provided in the carrier mechanism and the rotor mechanism of such textile yarn processing machines was accomplished manually. This manual threading operation was extremely time consuming and cumbersome and reduced the efficiency of the machine operation. More recently, pneumatically operated threading mechanisms have been provided for automatically threading the yarn through the yarn passageways of the carrier and rotor mechanisms. For example, U.S. Pat. No. 3,975,893 issued Aug. 24, 1976 and assigned to the assignee of the present invention, discloses a threading mechanism wherein an injector nozzle is provided in the stationary carrier mechanism of the spindle assembly for creating a flow of air in the yarn passageways of the carrier mechanism and rotor mechanism when compressed air is supplied thereto.

In order for the pneumatic threading mechanism to thread a yarn through the yarn passageways of the spindle assembly, it is necessary to provide a clear path for threading the yarn through the yarn passageways by opening or releasing a yarn brake mechanism which is usually provided within the spindle assembly adjoining the yarn inlet tube. This has been heretofore accomplished in various ways. For example, in the case of a yarn brake mechanism employing a capsule-shaped braking cartridge, mechanisms have been provided for disengaging the braking cartridge when the yarn inlet tube is manually depressed. As described in German Auslegeschrift No. 2,543,018, for example, depressing the yarn inlet tube during the thread-up operation moves a bridging tube laterally into position to assist in guiding the yarn through the brake housing, with the bridging tube also serving to laterally displace the capsule-shaped braking cartridge. German Offenlegungschrift No. 2,309,578 discloses a somewhat similar arrangement wherein a capsule-shaped braking cartridge is displaced laterally by depressing the yarn inlet tube, with the braking cartridge being held in the laterally displaced position out of the path of yarn travel by a magnet. In both of the arrangements just described, the yarn brake mechanism must be disengaged or released manually by depressing the yarn inlet tube before a thread-up operation can be carried out, which is undesirable when automatic threading mechanisms are used.

In U.S. Pat. No. 3,945,184 issued Mar. 23, 1976, and assigned to the assignee of the present invention, there is disclosed a yarn brake mechanism for a two-for-one twisting spindle assembly wherein the yarn passageway extending through the spindle assembly is locally widened to form a cavity, the upper end of which is in the form of a flat oblique braking surface extending around the yarn inlet opening of the yarn passageway into the cavity. The braking element of this yarn brake mechanism comprises a braking plate made from a ferromagnetic material and which is positioned covering the yarn inlet opening into the cavity. An adjustable permanent magnet is provided for biasing the brake plate toward the braking surface for applying a desired variable tension to a yarn entering the cavity through the yarn inlet opening. In order to pneumatically thread a yarn past a yarn brake mechanism of this type, means were previously provided on the outside of the spindle assembly whereby an operator could manually cause the braking plate to be moved away from the braking surface during a thread-up operation. In order to avoid the need for manual release of the brake mechanism by the operator, the above-mentioned U.S. Pat. No. 3,945,184 has proposed that the stationary braking surface be provided with a bypass channel which adjoins the yarn passageway and through which the yarn is passed during the pneumatic threading operation without the necessity of moving the braking plate off the braking surface. During the subsequent start-up of the spindle assembly the yarn is tensioned and as a result is reintroduced from the bypass channel into position between the braking surface and the braking plate.

OBJECTS AND SUMMARY OF THE INVENTION

It is an object of the present invention to provide in a spindle assembly of a textile yarn processing machine, such as a two-for-one twister, an improved yarn brake mechanism which is associated with the compressed air operated threading mechanism in such a way that during the pneumatic threading of the yarn through the elongate yarn passageways of the spindle assembly, the yarn brake mechanism is automatically disengaged or released to provide an unobstructed path of travel for threading the yarn past the brake mechanism.

This is accomplished in accordance with the present invention by poviding an improved yarn brake mechanism which is normally in an engaged position for engaging and applying tension to the yarn during processing, and which is mounted for movement to a disengaged or released position under the influence of the same compressed air which is supplied to the threading mechanism for the thread-up operation.

The improved brake mechanism of the present invention comprises a braking member and a cooperating braking surface which are mounted for movement with respect to one another between an engaged position with the braking member in engagement with the braking surface for engaging and applying tension to a yarn passing therebetween, and a released or disengaged position with the braking member out of engagement with the braking surface to permit a yarn to readily pass therebetween. Means is provided cooperating with the braking member and with the braking surface and actuable by the same compressed air which is supplied to the threading mechanism for moving the cooperating braking member and braking surface from the engaged position to the released or disengaged position.

In accordance with one embodiment of the invention illustrated herein, the braking mechanism is of the type employing a capsule-shaped braking cartridge which is normally positioned with opposite ends thereof engaging upper and lower rings serving to define braking surfaces. The yarn passes through the upper and lower rings, with tension being applied thereto as it passes between the braking cartridge and the braking surfaces defined by the rings. In order to disengage this type of brake mechanism for a thread-up operation, means is provided which is actuable by the compressed air supplied to the threading mechanism for shifting one of the rings axially away from the other ring to release the braking cartridge, with means being provided for moving the braking cartridge upon the release thereof by the rings laterally out of the path of the yarn. Preferably this is accomplished by a magnet which is located adjacent to the cartridge for attracting the cartridge upon the release thereof by the rings. Several different arrangements or embodiments are disclosed whereby the rings may be moved axially away from one another under the influence of the compressed air which is supplied to the threading mechanism.

In accordance with another embodiment of the invention, the brake mechanism is located in an enlarged cavity forming a part of and enlarging the yarn passageway through the spindle assembly, and the braking surface comprises a generally flat inclined surface defining the inlet end of the enlarged cavity. A movable braking member in the form of a braking plate is positioned for covering the yarn passageway at the inlet end of the cavity, with means being provided for biasing the braking plate into engagement with the braking surface to thus engage and apply tension to a yarn passing therebetween. The braking surface and braking plate are located downstream of the threading mechanism and so positioned that the compressed air which is applied to the threading mechanism is directed onto the braking plate so as to overcome the biasing means and to move the braking plate out of engagement with the braking surface and thus provide a clear path for threading the yarn through the yarn passageway.

The present invention also provides an improved method for threading a yarn through an elongate yarn passageway of a hollow spindle assembly and past a yarn brake mechanism located therein, the yarn brake mechanism normally being positioned for engaging the yarn and applying a desired tension thereto during processing. In accordance with the method of the present invention, the yarn is threaded through the yarn passageway by directing compressed air through the yarn passageway to pneumatically thread the yarn therethrough while also applying the compressed air to the brake mechanism for effecting disengagement thereof to thus provide an unobstructed path for the yarn through the yarn passageway. The step of applying the compressed air to the brake mechanism can be carried out in various ways. For example, the compressed air can be directed directly onto a movable part of the brake mechanism so as to effect movement thereof from the normally engaged position to the released or disengaged position. Alternatively, the yarn brake mechanism may be moved indirectly, by directing the compressed air onto a movable element which, in turn, is connected to a movable part of the brake mechanism for thus effecting movement of the brake mechanism from the normally engaged position to the released position. Still another method of disengaging the brake mechanism involves applying to a movable part of the brake mechanism a suction air flow which is created by the compressed air being directed through the yarn passageway for thus moving the brake mechanism from the normally engaged position to the released or disengaged position.

Further specific features of the apparatus and method of the present invention will become apparent from the detailed description of the preferred embodiments to follow.

BRIEF DESCRIPTION OF THE DRAWINGS

Some of the objects and advantages of this invention having been set forth, other objects and advantages will appear, when taken in conjunction with the accompanying drawings, in which.

DESCRIPTION OF THE ILLUSTRATED EMBODIMENTS

While the drawings and specific description to follow will be related to a two-for-one twister textile yarn processing machine, which is the preferred textile yarn processing machine utilizing the improved mechanisms of this invention, it is to be understood that these improvements could also be utilized on other textile yarn processing machines utilizing a yarn brake mechanism and associated compressed air operated threading mechanism.

Figure 1:
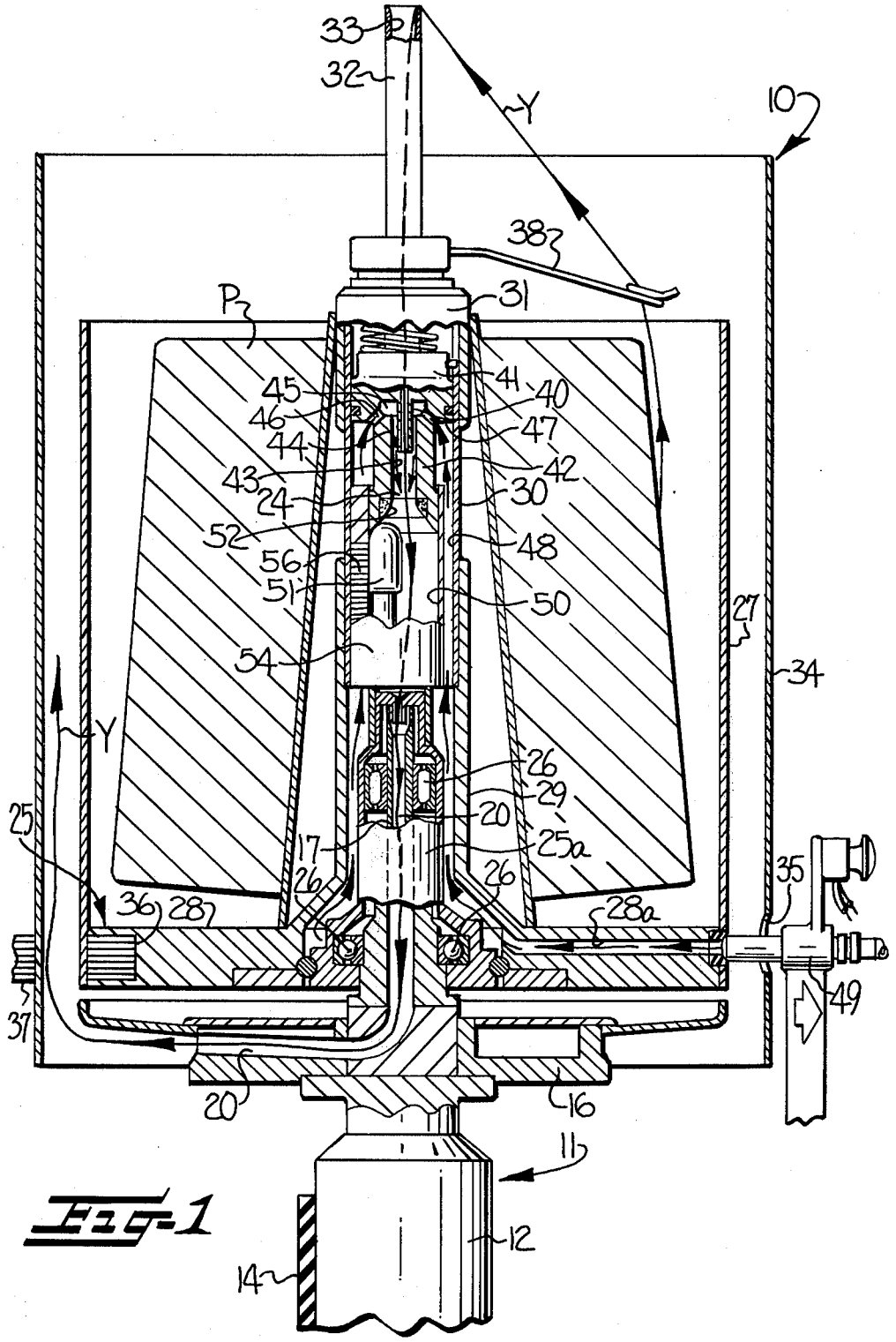
FIG. 1 is an enlarged cross-sectional elevational view, of one spindle assembly station of a textile yarn processing machine utilizing the improved, self-threading yarn brake mechanism of this invention.

Referring now to the drawings, there is illustrated in FIG. 1 a schematic cross-sectional view of a single spindle assembly station, generally indicated at 10, of a two-for-one twister textile yarn processing machine. It is to be understood that a plurality of these spindle assembly stations 10 are provided in side-by-side relationship in two rows along the outside of the machine. A full illustration and description of the entire two-for-one twister yarn processing machine is not given herein and is not believed to be necessary for an understanding of the present invention, the operation and complete structure of such a two-for-one twister being well understood by those with ordinary skill in the art.

Generally, each of the spindle assembly stations 10 comprises a rotatably driven rotor mechanism, generally indicated at 11, which includes a whorl 12 suitably rotatably mounted on a portion of the twister frame (not shown) and rotated by a continuous tangential drive belt 14 in a manner well understood by those with ordinary skill in the art. The rotor mechanism 11 further includes a horizontally extending yarn reserve disc 16 secured to the whorl 12 for rotation therewith and a generally vertically extending hollow axle 17 which also rotates with the reserve disc 16. The reserve disc 16 and the hollow axle 17 define therewithin a generally L-shaped yarn passageway 20 extending generally vertically through the hollow axle 17 and a portion of the yarn reserve disc 16 and generally horizontally and radially out of the yarn reserve disc 16.

Figure 2:
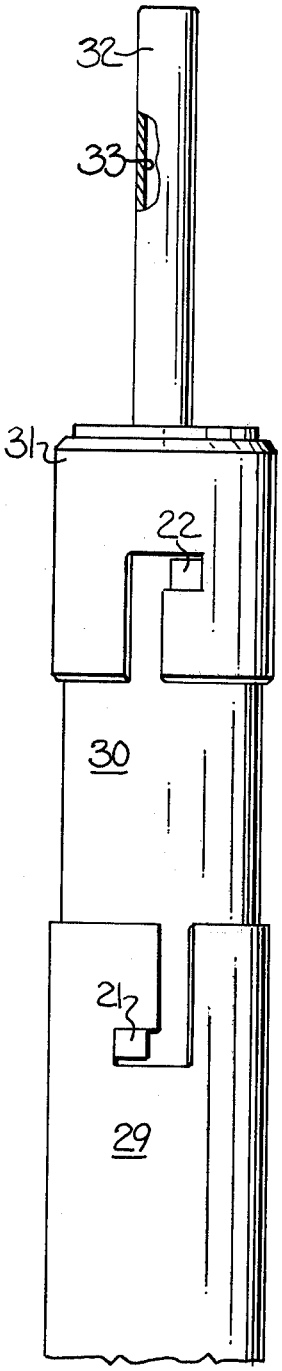
FIG. 2 is an enlarged elevational view of the upper portion of the spindle assembly of FIG. 1.

The spindle assembly 10 further includes a stationary carrier mechanism, generally indicated at 25, for supporting and carrying a hollow supply package P of yarn Y. The carrier mechanism 25 is mounted on the rotor mechanism 11 by bearings 26 so that the rotor mechanism 11 may rotate relative to the stationary carrier mechanism 25. The carrier mechanism 25 includes a basket device 27 which surrounds the package P, a circular bottom portion 28 for supporting the hollow yarn supply package P and a hollow tubular hub portion 29 extending upwardly into the hollow yarn supply package P for stabilizing the yarn supply package. A tubular housing 30 is carried by and extends upwardly from the upper end of the hub portion 29 and in which is contained the pneumatic yarn threading mechanism and the yarn brake mechanism, both to be described more fully hereinafter. A cap 31 is mounted at the upper end of the tubular housing 30 from which extends a hollow tubular yarn entry tube 32. As illustrated in FIG. 2, the housing 30 is telescopically received in the open upper end of the tubular hub portion 29 and removably secured by a bayonet closure 21. A bayonet closure 22 is also provided for securing cap 31 to the upper end of housing 30.

The yarn entry tube 32 has an axially extending passageway 33 for receiving and allowing passage of the yarn Y therethrough. As explained more fully hereinafter, the yarn brake mechanism and the associated yarn threading mechanism which are contained within the tubular housing 30 also have an axially extending yarn passageway 24 therethrough joining at the upper end with the passageway 33 of the yarn entry tube and at the lower end with the L-shaped passageway 20 of the rotor mechanism 11 to thus collectively provide a continuous yarn passageway (33, 24, 20) extending through the spindle assembly.

The spindle assembly 10 further includes a balloon limitor device 34 surrounding the basket 27 so as to contain a balloon of yarn Y formed around the outside of the basket 27. The balloon limitor 34 has an aperture 35 therein for purposes to be described below. In order to maintain the textile yarn package carrier mechanism 25 stationary during rotation of the rotor mechanism, there are provided magnets 36 carried by the bottom portion 28 and cooperating with magnets 37 carried by the balloon limitor device 34 to prevent rotation of the carrier mechanism 25.

The spindle assembly 10 further includes a flyer mechanism 38 mounted on the yarn entry tube 32 for free rotation about the axis of the spindle assembly. There is further provided a take-up mechanism (not shown) including a yarn take-up or package roll upon which the yarn Y is wound after being processed by the spindle assembly station 10. The take-up mechanism is conventional in a two-for-one twister yarn processing machine and an illustration thereof and further explanation is not believed necessary for a full understanding of this invention.

With the above-described mechanisms of the spindle assembly station 10, the yarn Y passes from the package P, through the rotating flyer mechanism 38, and into the yarn entry tube 32. The yarn then passes downwardly through the yarn passageways 33 and 24 of the carrier mechanism and through the passageway 20 of the rotor mechanism 11, emerging from the yarn reserve disc 16 in a generally horizontal direction. The yarn then passes upwardly between the basket 27 and the balloon limitor 34 and forms a rotating balloon of yarn which is contained by the balloon limitor 34. The yarn then passes upwardly to the take-up mechanism to complete its travel through the respective spindle assembly station 10. As is well understood by those with ordinary skill in the art, a two-for-one twist is inserted in the yarn Y during the above-noted path of travel.

Figure 3:
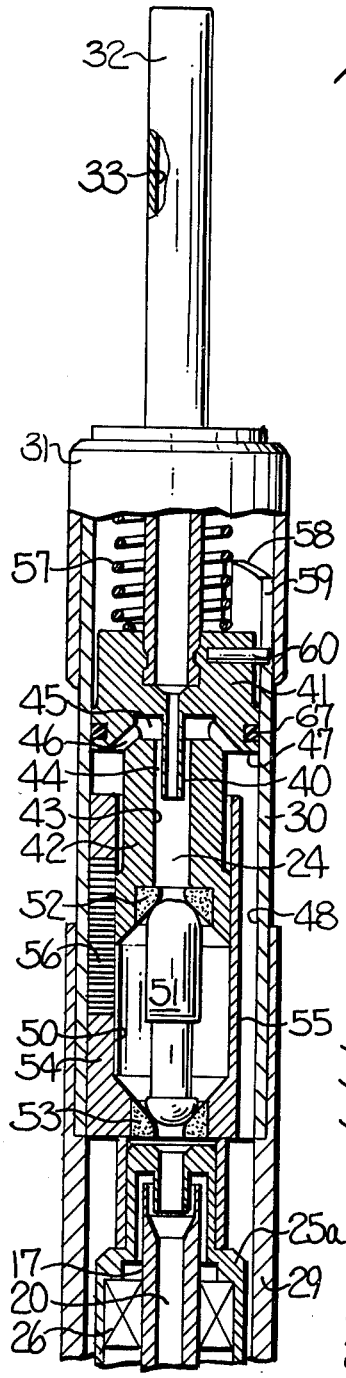
FIG. 3 is an axial sectional view of the spindle assembly of FIG. 2 showing the yarn brake mechanism of the present invention and the associated compressed air operated threading mechanism and wherein the yarn brake mechanism is in the engaged position for operation.

To assist in threading the yarn Y from the package P through the respective passageways 33 and 24 of the carrier mechanism 25 and the passageway 20 of the rotor mechanism 11 during a periodic thread-up operation when the rotation of the rotor mechanism is stopped, the spindle assembly station 10 is provided with a pneumatically operated yarn threading mechanism. The yarn threading mechanism, more particularly, as seen for example in FIGS. 1, 3 and 4, comprises an air injector nozzle 40 mounted within the tubular housing 30 of the carrier mechanism 25 adjoining the lower end of the passageway 33 of yarn entry tube 32. The air injector nozzle 40 is supported in the centrally located bore of a hollow annular insert 41 which is mounted for axial movement within tubular housing 30. Insert 41 has a reduced diameter hollow cylindrical projection 42 at the lower end thereof having a hole 43 extending axially therethrough and defining a portion of the yarn passageway 24 through the carrier mechanism. The air injector nozzle 40 extends downwardly into the hole 43 in spaced relation from the walls thereof and leaving an annular gap 44 therebetween. The injector air nozzle 40 is surrounded by an annular chamber 45 formed in insert 41 and which communicates with the annular gap 44. Compressed air passageways 46 extend from the annular chamber 45 outwardly to the general area of the transition between the annular insert 41 and the reduced diameter cylindrical projection 42. At this transition there is defined an annular piston face 47. Here the passageways 46 communicate with an axially extending compressed air duct 48 provided within the carrier mechanism 25.

When compressed air is supplied to the compressed air duct 48 during a thread-up operation, this air passes through the compressed air passageways 46 and the annular chamber 45 and then downwardly through the annular gap 44 between the air injector nozzle 40 and the wall defining the hole 43. This produces a suction air flow in the passageway 33 of the yarn entry tube 32 and a positive air flow through the passageways 24, 20 located therebelow by which a yarn Y withdrawn from the package P at the entry of the yarn entry tube 32 is sucked through the passageway 33 and pneumatically threaded through the passageways 24 and 20 by the positive air flow therethrough.

Compressed air may be selectively supplied to the compressed air duct 48 of the carrier mechanism 25 during a thread-up operation by suitable means, as for example the arrangement shown in commonly owned U.S. Pat. Nos. 3,945,184 or 3,975,893. Thus, as shown by way of illustration in FIG. 1, compressed air may be selectively supplied by means of a selectively movable connector member 49 which is connected to a compressed air supply (not shown). The connector member 49 is positioned for movement into an out of connecting engagement with the outer end of an air duct 28*a* extending radially through the bottom portion 28 of the carrier member 25. The connector member 49 is mounted for movement through the aperture 35 in the balloon limitor device 34. From the inner end of radial air duct 28*a* the compressed air is directed upwardly through the annular space provided between the tubular hub portion 29 and a tubular wall portion 25*a* forming a part of the carrier member 25, and then to the compressed air duct 48.

In the embodiment of the invention illustrated in FIGS. 1 to 4, the yarn brake mechanism is located downstream of the threading mechanism in an enlarged cavity 50 forming a part of and enlarging the yarn passageway 24 which extends through the carrier member 25. The brake mechanism includes an elongate capsule-shaped braking cartridge 51. The braking cartridge may either be of a rigid design or may comprise two mutually telescopic capsule halves with an enclosed helical compression spring which biases the two capsule halves outwardly. Upper and lower annular braking rings 52, 53 are provided at opposite ends of the cavity 50 surrounding the entrance and exit of the passageway 24 through the cavity 50. The braking rings 52, 53 define respective braking surfaces which are adapted to engage the rounded opposite end portions of the braking cartridge 51 and to thus apply tension to a yarn passing along the yarn passageway 24 and between the braking cartridge 51 and the respective braking surfaces of the upper and lower braking rings 52, 53.

The upper braking ring 52 is mounted at the free end of the cylindrical projection 42. The lower braking ring 53 is supported by a stationary annular shaped lower insert 54 which is fixedly secured within the tubular housing 30. A hollow annular inner sleeve portion 55 forms a part of and extends axially upwardly from the lower part of lower insert 54, the hollow interior of sleeve portion 55 defining the side walls of enlarged cavity 50. The lower insert 54 and the adjoining sleeve portion 55 are so designed as to provide an axially extending compressed air duct or channel 48 leading upwardly past the yarn brake mechanism to the threading mechanism. A permanent magnet 56 is provided in the side wall of the inner sleeve portion 55, the function of which will be described hereinafter. The free end portion of the cylindrical projection 42 is telescopically received within the annular sleeve portion 55 in closely fitting relation so as to form a seal therewith.

A helical compression spring 57 is provided at the upper end of the carrier member 25 surrounding the lower portion of the yarn inlet tube 32 and is held in compression between the inside of the cap 31 and the uppermost surface of the upper insert 41. Spring 57 thus serves to bias the upper insert 41 and the upper braking ring 52 carried thereby axially toward the lower braking ring 53 so as to apply a desired pressure on opposite end portions of the braking cartridge 51. At the upper end of the tubular housing 30 there is formed in a portion of the wall thereof an oblique section 58 in which there is formed a series of axially extending grooves of various depths, one of the grooves 59 being shown in FIGS. 3 and 4. A positioning pin 60 carried by the upper insert 41 extends laterally outwardly and is received in the groove 59. The pressure exerted on the braking cartridge 51, and thus the tension applied to the yarn passing through the yarn brake mechanism, may be adjusted by selectively positioning the pin 60 in one of the various grooves provided. This is accomplished by grasping the yarn inlet tube 32 and pulling the tube upward against the pressure exerted by the spring 57, followed by rotating the yarn inlet tube 32 to select the relevant desired groove corresponding to the desired amount of tension to be applied to the yarn, and then releasing the yarn inlet tube and allowing the pin 60 to seat in the selected groove. In this regard, it will be noted that the yarn inlet tube 32 is keyed to the upper insert 41 so as to be rotatable therewith.

Figure 4:
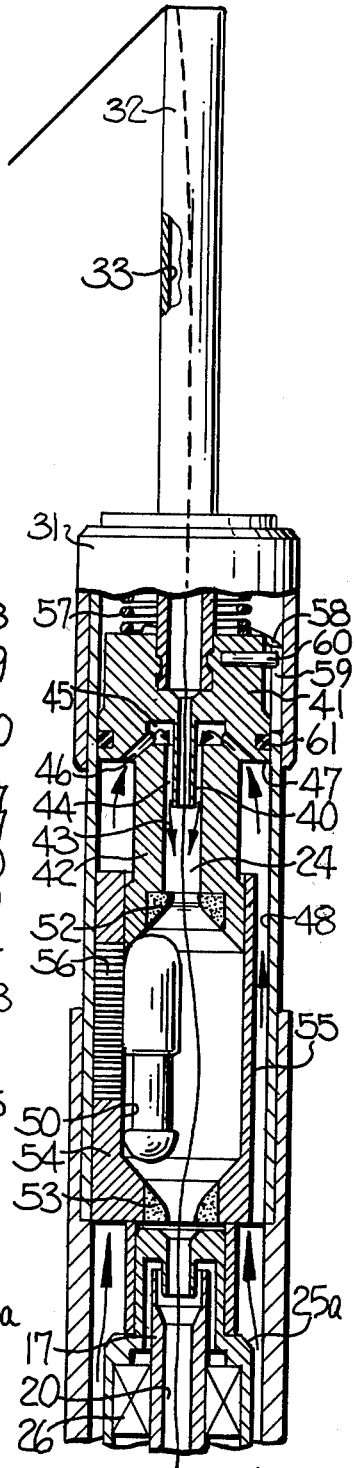
FIG. 4 is a view similar to FIG. 3 but showing the yarn brake mechanism in the released or disengaged position for thread-up.

Referring now to FIG. 4, it will be seen that when compressed air is directed into the compressed air duct 48 from below, as indicated by the air flow arrows, for purposes of threading a yarn through the yarn passageways as earlier described, the compressed air acts on the annular piston surface 47, and as a result causes the upper insert 41 to be moved axially upwardly overcoming the downward bias of the compression spring 57. Thus, it will be seen that the upper insert 41 functions as a piston. To assist in maintaining an effective seal between the upper insert 41 and the surrounding tubular housing 30, a sealing member 61, such as an O-ring, is provided in a suitable recess in the periphery of the upper insert 41.

As a result of the upward axial movement of the upper braking ring 52 relative to the stationary lower ring 53, the braking cartridge 51 is released. Due to the braking cartridge 51 being made of a ferromagnetic material, or at least including a ferromagnetic element, it is attracted by the magnet 56 and moved laterally so as to provide a clear path for passage of the yarn through the cavity 50. When the compressed air is turned off upon the completion of the thread-up operation, the upper braking ring is returned to its original position under the influence of the spring 57, and the braking cartridge 51 is moved back into its operating position in engagement with the braking rings 52, 53. The endmost faces of the upper and lower inserts 41, 54 are of a conical or funnel shaped configuration in order to facilitate this return movement of the braking cartridge 51.

Figure 5:
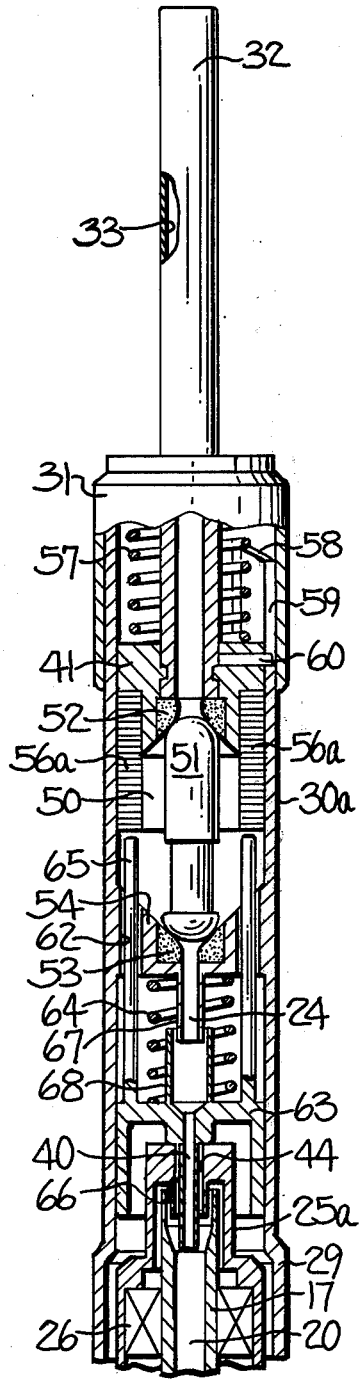
FIG. 5 is an axial sectional view of a spindle assembly showing an alternate embodiment of the yarn brake mechanism of the present invention, with the yarn brake mechanism in the engaged position.
Figure 6:
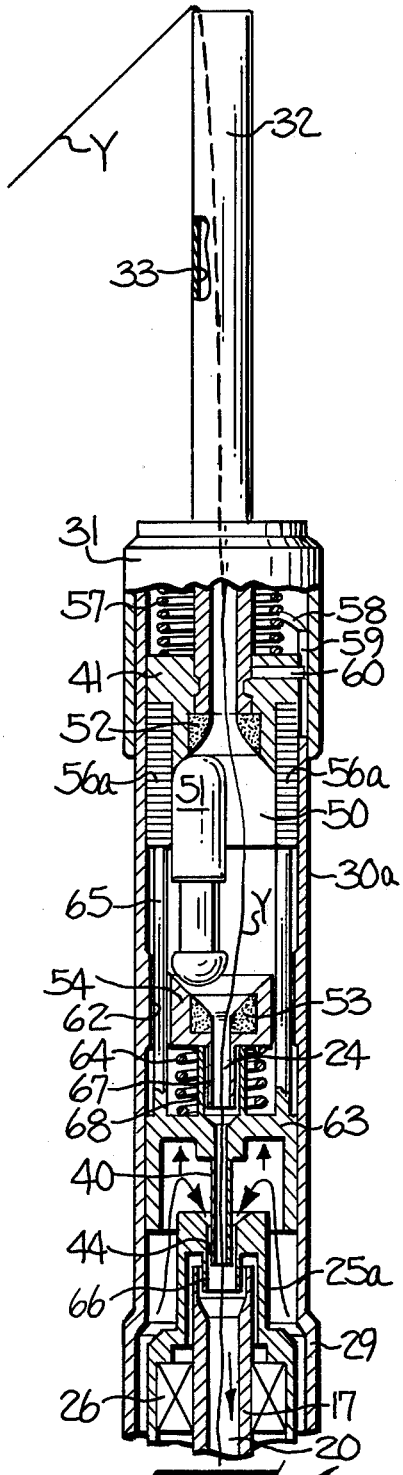
FIG. 6 is a view similar to FIG. 5 but showing the yarn brake mechanism in the released position.

The embodiment of the invention illustrated in FIGS. 5 and 6 is similar in many respects to that previously described with reference to FIGS. 1 to 4. To avoid repetitive description, the same reference characters will be used wherever applicable to identify elements corresponding to those previously described. As in the embodiment previously described, the braking mechanism illustrated in FIGS. 5 and 6 employs a capsule-shaped braking cartridge 51. However, in this embodiment the threading mechanism, and the air injector nozzle 40 forming a part thereof, are located downstream of the yarn brake mechanism. In this embodiment the tubular housing 30*a* for the yarn brake mechanism is formed as an integral extension of the hub portion 29. The upper insert 41 is mounted for axial movement within the tubular housing 30*a* with the upper braking ring 52 being mounted at the lower end thereof. Permanent magnets 56*a* are carried by the upper insert 41 and extend downwardly therefrom. The upper insert 41 is biased axially downwardly by the helical spring 57 so as to bring the upper braking ring 52 into engagement with the rounded upper end portion of the braking cartridge 51.

The lower braking ring 53 is supported by lower insert 54 which is fixedly secured within the tubular housing 30*a* with axially extending channels 62 passing therethrough. An axially movable annular piston 63 is positioned within the tubular housing 30*a* below the lower insert 54 and is biased downwardly away from lower insert 54 by a helical compression spring 64. Elongate thrust pins 65 extend upwardly from the piston 63 through the channels 62, with the upper ends of the thrust pin 65 engaging the magnets 56*a*. The injector nozzle 40 is coaxially fitted to the underside of piston 63 and extends downwardly into a connector tube 66 located at the upper end of the tubular wall portion 25*a*. Connector tube 66 is somewhat larger than the air injector nozzle 40 and leaves an annular gap 44 therebetween for passage of the compressed air. A yarn guide tube 67 is coaxially mounted on the underside of lower insert 54 and extends downwardly therefrom and is telescopically received within a cooperating larger diameter tube 68 carried by the upper side of piston 63. The tubes 67, 68 thus serve to define a portion of the yarn passageway 24 extending through the carrier member 25.

Referring now to FIG. 6, it will be seen that when compressed air is supplied to the annular gap between the hub portion 29 and wall portion 25*a* in the manner previously described in connection with FIGS. 1–4, the compressed air stream acts on the underside of piston 63 and moves the piston upwardly against the biasing force of the spring 64. As a result, the thrust pins 65 also cause the upper insert 41 to be moved axially upwardly against the force of spring 57. This causes enlargement of the distance between braking rings 52, 53 so that the braking cartridge 51 is released and is laterally attracted to the permanent magnets 56*a*, thus providing a clear passageway for the yarn through the enlarged cavity 50 of the yarn brake mechanism. The compressed air also passes through the annular gap 44 between the air injector nozzle 40 and the surrounding connector tube 66, thus creating a positive flow of air through the passageway 20 of the hollow axle 17 and a suction flow of air in the yarn passageways 33, 24 located above the injector nozzle which thus serve to draw a yarn into and through the collective yarn passageways 33, 24, 20 of the spindle assembly. When the compressed air is turned off, the springs 57 and 64 cause the axially displaceable elements to be restored to their original operative positions.

Figure 7:
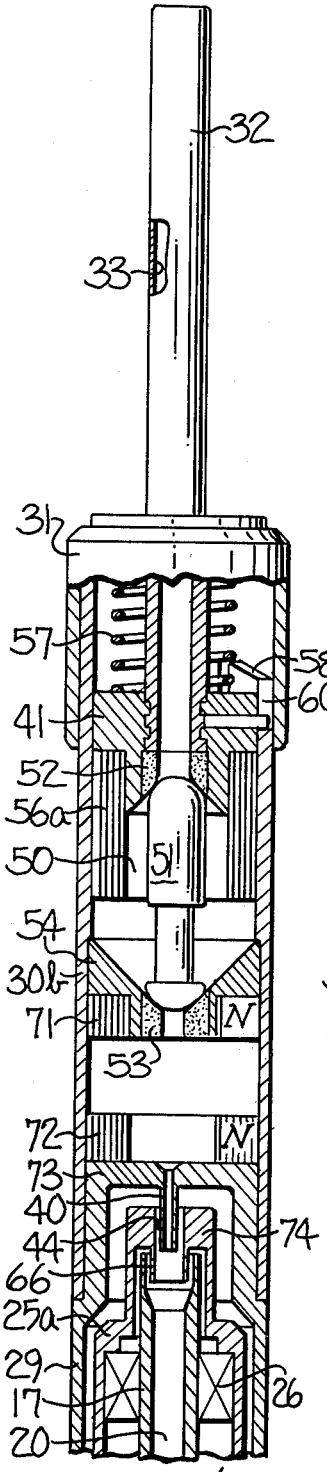
FIG. 7 is an axial sectional view of a spindle assembly showing a further embodiment of a yarn brake mechanism and associated threading mechanism, with the yarn brake mechanism shown in the engaged position.
Figure 8:
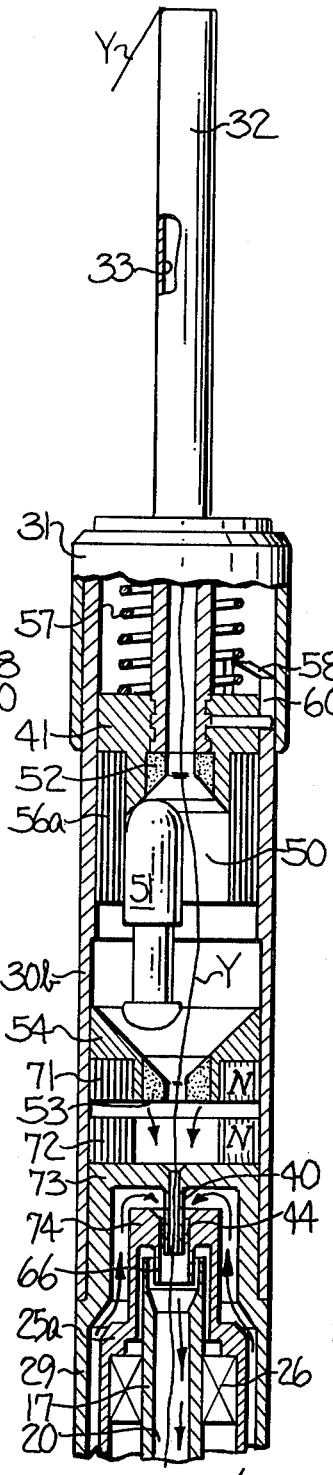
FIG. 8 is a view similar to FIG. 7 but showing the yarn brake mechanism in the released position.

The embodiment illustrated in FIGS. 7 and 8 is similar in many respects to that previously described with reference to FIGS. 5 and 6, and again, to avoid repetitive description, elements which have been previously described will be identified by the same reference characters wherever applicable. As illustrated, the tubular housing 30*b* is slipped over the upper end of the hub portion 29. The upper insert 41 and the upper braking ring 52 are mounted for axial movement within housing 30*b* so as to permit adjustment over the amount of tension applied to the yarn in the manner previously described.

In this embodiment of the invention the lower insert 54 and the lower braking ring 53 which is carried thereby are mounted for axial movement within the tubular housing 30*b*, with the lower insert 54 fitting closely with the walls of the housing 30*b* to form a seal therewith. The lower insert 54 is magnetically biased upwardly toward and into engagement with the lower end portion of the braking cartridge 51 in a manner similar to that described in German Patentschrift No. 1,510,807.

As illustrated, an annular magnet 71 is mounted on the underside of the lower insert 54 and a similar magnet 72 is located below the magnet 71 and carried by a stationary flange member 73. The magnets 71, 72 have their polarities oriented so that they repel one another and thus serve to bias the lower insert 54 axially upwardly into engagement with the lower rounded end portion of the braking capsule 51. The air injector nozzle 40 is coaxially mounted in the stationary flange member 73 and extends downwardly therefrom into a surrounding larger diameter tube 74 carried at the upper end of the spindle wall portion 25*a* and opening into the passageway 20 of the hollow axle 17.

When compressed air is supplied to the annular space between the hub portion 29 and spindle wall portion 25*a* in the manner previously described, the compressed air passes downwardly through an annular gap 44 between the air injector nozzle 40 and the surrounding tube 74 creating a positive flow of air below the air injector nozzle for conveying a yarn Y through the yarn passageway 20 and, by an injector effect, a suction flow of air above the air injector nozzle 40. As indicated by the air flow arrows in FIG. 8, the suction air flow acts on the movable lower insert 54 to pull the same downwardly, overcoming the upward bias of the magnets 71, 72 and thus moving the braking rings 52, 53 away from one another to release the braking cartridge 51. Upon release thereof, the cartridge 51 is attracted laterally out of the path of yarn travel by the magnets 56*a*. When the compressed air flow is stopped, the forces of the magnets 71, 72 return the insert 54 upwardly to its original operative position with the opposite ends of the braking cartridge 51 engaged between the upper and lower braking rings 52, 53.

Figure 9:
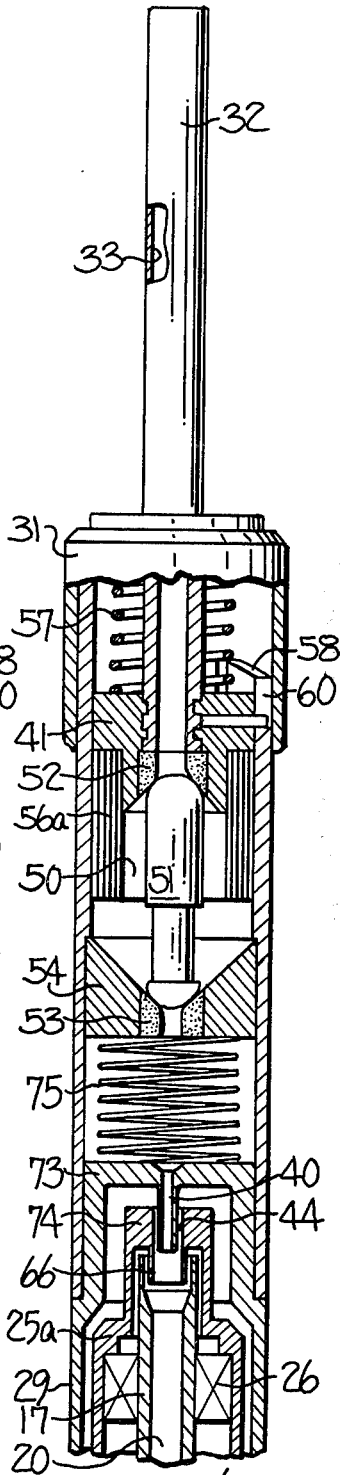
FIG. 9 is a view similar to FIG. 7 showing a further embodiment of the yarn brake mechanism.

FIG. 9 illustrates a modified form of the embodiment of FIGS. 7 and 8, wherein the means for biasing the lower insert 54 upwardly into engagement with the braking capsule 51 comprises a helical coil compression spring 75 instead of magnetic biasing means. In all other respects, this modified form of the invention operates in the manner previously described with reference to FIGS. 7 and 8.

Figure 10:
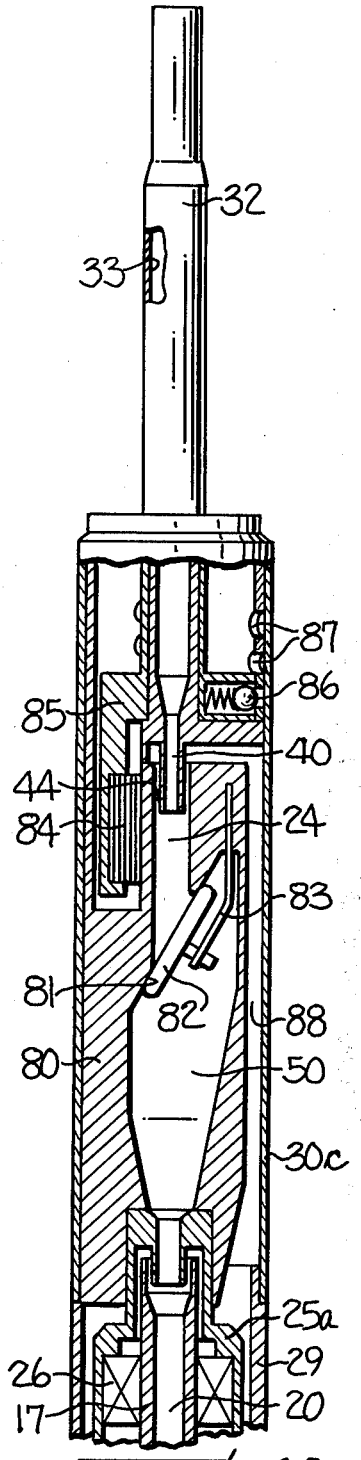
FIG. 10 is an axial sectional view of a spindle assembly showing still another embodiment of a yarn brake mechanism and associated threading mechanism in accordance with the present invention, and wherein the yarn brake mechanism is in the engaged position.
Figure 11:
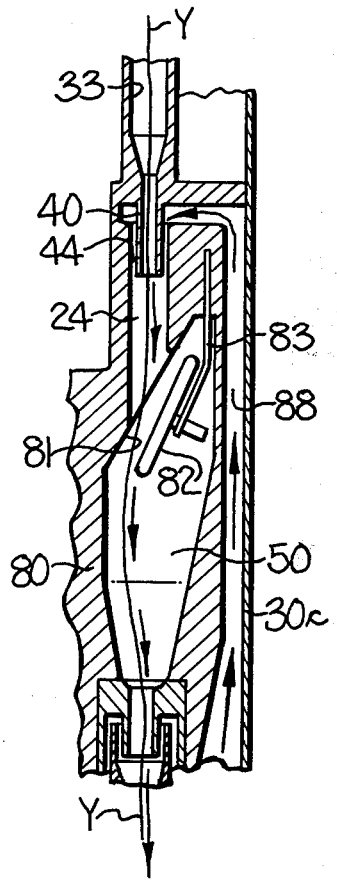
FIG. 11 is a fragmentary axial sectional view of the arrangement shown in FIG. 10 as the yarn brake mechanism appears in the released position during the thread-up operation.

The embodiment of the invention shown in FIGS. 10 and 11 is based on the plate-type yarn brake mechanism generally of the type described in the aforementioned commonly owned U.S. Pat. No. 3,945,184 and in U.S. Pat. No. 3,490,221 issued Jan. 20, 1970 and assigned to the assignee of the present invention.

As illustrated, a tubular housing 30*c* is carried by and extends upwardly from the upper end of the hub portion 29. Contained within the tubular housing 30*c* is an insert 80 having an elongate yarn passageway 24 extending axially therethrough, joining at the upper end with the passageway 33 of the yarn entry tube 32 and at the lower end with the yarn passageway 20 of the rotor mechanism 11. The yarn passageway 24 is locally widened to form an enlarged cavity 50 forming a part of and enlarging the yarn passageway 24. The upper end of the cavity 50 is defined by a generally flat inclined oblique surface 81 generally surrounding the passageway 24 at the entrance to the enlarged cavity 50 and serving as a braking surface. The braking member of this embodiment comprises a braking plate 82 which is made at least partially from a ferromagnetic material and which is positioned for generally covering the yarn passageway 24 at the entrance to the cavity 50. Plate 82 is mounted for movement within the cavity 50 by a spring 83 or other suitable means. A permanent magnet 84 is mounted in magnetically attracting proximity to the ferromagnetic braking plate 82 and serves for biasing the braking plate 82 toward and into engagement with the braking surface 81 for thereby engaging and applying a desired tension to a yarn passing along the yarn passageway 24 and between the braking plate 82 and the braking surface 81. The magnet 84 is mounted in a known manner for movement axially toward or away from the ferromagnetic braking plate 82 for thus permitting adjustment of the amount of tension applied to the yarn passing through the yarn brake mechanism. Thus, as illustrated, the magnet is carried by a mounting block 85, which in turn, is mounted to the lower end of the yarn entry tube 32. The axial position of the magnet 84 relative to the braking plate 82 may be adjusted by manually grasping the yarn entry tube 32 and lifting the same so as to selectively position a spring loaded catch 86 in one of several axially spaced holes or detents 87.

The air injector nozzle 40 is located upstream from the braking plate 82 adjoining the lower end of the yarn entry tube 32. The air injector nozzle 40 extends into the axially extending yarn passageway 24 formed in the insert 80 and in spaced relation from the walls thereof to form an annular gap 44 for passage of compressed air. The insert 80 is formed in such a manner as to provide an axially extending compressed air duct 88 leading upwardly to the air injector nozzle from below.

When compressed air is supplied to the compressed air duct 88 in the manner previously described with reference to FIG. 1, the air travels upwardly along the compressed air duct 88 as indicated by the air flow arrows of FIG. 11 and then downwardly through the annular gap 44 between the air injector nozzle 40 and the walls defining the upper portion of the yarn passageway 24. This results in the creation of a suction air flow in the yarn passageway 33 of the yarn entry tube 32 for drawing a yarn Y into and downwardly through the yarn passageway 33 while also producing a positive air flow in the yarn passageway 24 and in the adjoining yarn passageway 20 located downstream therefrom for thus automatically threading the yarn through the collective passageways 33, 24, 20 of the spindle assembly 10.

As seen in FIG. 11, since the braking plate 82 is located in the path of the discharge air from the air injector nozzle 40, the force of the air impinging on the surface of the braking plate 82 causes the braking plate to be moved out of engagement with the braking surface 81 to thus automatically disengage the yarn brake mechanism and provide a clear path of travel for the yarn through the enlarged cavity 50 and into the passageway 20 of the rotor mechanism. When the compressed air is stopped upon the completion of the thread-up operation, the biasing force of the magnet 84 returns the braking plate 82 to its normal operative position in engagement with the braking surface 81.

From the foregoing description of several illustrative embodiments of the invention, it will be seen that the present invention has provided an improved method of pneumatically threading a yarn through a spindle assembly, together with an improved yarn brake mechanism which cooperates with the pneumatic threading mechanism in such a manner that the yarn brake mechanism is automatically disengaged or released by the effect of the compressed air which is supplied to the threading mechanism for a thread-up operation to thus automatically provide an unobstructed path of travel for threading the yarn past the brake mechanism. The present invention thus greatly facilitates the automatic threading of yarn through a spindle assembly and avoids the need for manually disengaging the brake mechanism as has been heretofore necessary in many of the prior spindle assemblies.

In the drawings and specification there have been set forth preferred embodiments of the invention, and although specific terms are employed, they are used in a generic and descriptive sense only and not for purposes of limitation.

What is claimed is:

1. In a textile yarn processing machine, such as a two-for-one twister or the like, having a plurality of spindle assemblies, each having an elongate yarn passageway extending therethrough and including a threading mechanism having a compressed air operated injector nozzle operable for sucking a yarn into said yarn passageway at the inlet end thereof and for automatically threading the yarn through the yarn passageway during a thread-up operation, the combination therewith of an improved yarn brake mechanism for applying a desired tension to the yarn passing through said passageway during operation of the yarn processing machine, said yarn brake mechanism being constructed to cooperate with said threading mechanism to facilitate automatic threading of a yarn through said yarn passageway and comprising a tubular brake housing located in said spindle assembly with said yarn passageway extending axially therethrough, an upper hollow insert mounted within said brake housing with said yarn passageway extending therethrough, and including means defining the upper end of an enlarged cavity forming a part of and enlarging a portion of said yarn passageway, and an upper annular braking ring surrounding the yarn passageway at the entrance to said cavity, a lower hollow insert mounted within said brake housing with said yarn passageway extending therethrough, and including means defining the lower end of said enlarged cavity, and a lower annular braking ring surrounding the yarn passageway at the exit from said cavity, an elongate capsule-shaped braking cartridge positioned within said cavity with opposite ends thereof adapted to be positioned in engagement with said upper and lower braking rings, means for biasing said upper and lower inserts toward one another so that said upper and lower braking rings engage opposite ends of said braking cartridge for applying tension to a yarn passing therebetween, means cooperating with one of said upper or said lower inserts and actuable by the compressed air supplied to said threading mechanism for overcoming said biasing means and moving said one insert away from the other insert to release said braking cartridge from engagement by said upper and lower braking rings, and means for moving said braking cartridge upon the release thereof by said upper and lower braking rings laterally out of the path of the yarn being threaded through said cavity to thus provide a clear path for threading the yarn through said yarn passageway.

2. The combination as set forth in claim 1 wherein said braking cartridge is made at least partially of a ferromagnetic material, and said means for moving the braking cartridge laterally comprises a magnet located adjacent to said cavity for attracting said braking cartridge upon the release thereof by said rings.

3. The combination as set forth in claim 1 wherein said upper insert is mounted for axial movement within said tubular brake housing, and wherein said biasing means cooperates with said upper insert for biasing the same axially toward said lower insert, and wherein said means for moving one of said upper or lower inserts comprises a piston face formed in said upper insert and exposed to the compressed air which is supplied to said threading mechanism for effecting axial movement of said upper insert in opposition to said biasing means and away from said lower insert upon the application of compressed air to said threading mechanism.

4. The combination as set forth in claim 3 wherein said injector nozzle is carried by said upper insert and centrally located therein.

5. The combination as set forth in claim 4 wherein said means on said upper insert defining the upper end of said cavity comprises a hollow cylindrical projection of smaller diameter than said insert and extending axially in spaced relation to said tubular brake housing, said upper braking ring being mounted on the free end of said cylindrical projection, and wherein said piston face is of annular configuration and formed at the transition between said insert and said reduced diameter cylindrical projection.

6. The combination as set forth in claim 5 wherein said upper insert includes an annular chamber surrounding said injector nozzle and communicating therewith, and including air passageways extending outwardly from said annular chamber to a location adjacent to said annular piston face for directing compressed air to said injector nozzle.

7. The combination as set forth in claim 6 including an annular sleeve carried by said lower insert and extending axially upwardly therefrom and defining the sides of said enlarged cavity, said annular sleeve being spaced from said brake housing to define a compressed air duct therebetween leading to said annular piston face, and wherein said cylindrical projection extends into said sleeve and in sealing engagement therewith.

8. The combination as set forth in claim 1 wherein said upper insert is mounted for axial movement within said tubular brake housing, and wherein said biasing means cooperates with said upper insert for biasing the same axially toward said lower insert, and wherein said means for moving one of said upper or lower inserts comprises an annular piston also mounted for axial movement within said brake housing and located below said lower insert and exposed to the compressed air which is supplied to said threading mechanism for effecting axial movement of said piston, and including means interconnecting said piston and said upper insert for effecting axial movement of said upper insert in opposition to said biasing means and away from said lower insert upon the application of compressed air to said threading mechanism.

9. The combination as set forth in claim 8 wherein said means interconnecting said piston and said upper insert comprise thrust pins extending from said piston axially past said lower insert and into engagement with said upper insert.

10. The combination as set forth in claim 9 wherein said lower insert is fixedly secured to said brake housing and including a helical compression spring located between said lower insert and said piston for biasing said piston away from said lower insert following the application of compressed air to said piston.

11. The combination as set forth in claim 1 wherein said lower insert is mounted for axial movement within said tubular brake housing, including a stationary flange member mounted within said brake housing below said lower insert and in which said injector nozzle is mounted, and including means cooperating with said stationary flange member and with said lower insert for biasing said lower insert axially upwardly toward said upper insert, and wherein the suction effect created on the upper side of said stationary flange upon the application of compressed air to said injector nozzle is operable for overcoming said biasing means and moving said lower insert axially away from said upper insert to thus release said braking cartridge from engagement by said upper and lower braking rings.

12. The combination as set forth in claim 11 wherein said biasing means comprises a pair of opposing permanent magnets carried respectively by said lower insert and by said stationary flange.

13. The combination as set forth in claim 11 wherein said biasing means comprises a helical compression spring.

14. In a textile yarn processing machine, such as a two-for-one twister or the like, having a plurality of spindle assemblies, each having an elongate yarn passageway extending therethrough with an enlarged cavity therein forming a part of and enlarging said yarn passageway, and including a threading mechanism having a compressed air operated injector nozzle operable for sucking the yarn into said passageway at the inlet end thereof and for automatically threading the yarn through said passageway during a thread-up operation, the combination therewith of an improved yarn brake mechanism for applying a desired tension to the yarn passing through said passageway during operation of the yarn processing machine, said yarn brake mechanism being constructed to cooperate with said threading mechanism to facilitate automatic threading of a yarn through said yarn passageway and comprising a stationary braking member in the upper portion of said cavity forming a generally flat inclined braking surface generally around said passageway at the entrance to said cavity, a movable ferromagnetic braking plate pivotally mounted within said cavity for cooperation with said stationary braking surface and for generally covering said passageway at the entrance to said cavity, magnet means mounted in magnetically attracting proximity to said ferromagnetic braking plate for biasing said braking plate toward said inclined braking surface to apply desired tension to a yarn passing therebetween during processing, said enlarged cavity and the braking plate contained therein being located downstream of said threading mechanism with said movable braking plate being positioned in the path of discharge of the compressed air which is supplied to said injector nozzle and so mounted as to be moved out of engagement with said braking surface by the force of the compressed air to thus provide a clear path for threading the yarn through the yarn passageway.

* * * * *